US007659879B2

(12) United States Patent
Han et al.

(10) Patent No.: US 7,659,879 B2
(45) Date of Patent: Feb. 9, 2010

(54) BACKLIGHT DRIVING CIRCUIT

(75) Inventors: Seung Jun Han, Kyongsangbuk-do (KR); Seong Hyun Yun, Chungcheonbuk-do (KR)

(73) Assignee: LG Display Co., Ltd., Seoul (KR)

( * ) Notice: Subject to any disclaimer, the term of this patent is extended or adjusted under 35 U.S.C. 154(b) by 711 days.

(21) Appl. No.: 10/878,150

(22) Filed: Jun. 29, 2004

(65) Prior Publication Data

US 2005/0007333 A1 Jan. 13, 2005

(30) Foreign Application Priority Data

Jul. 8, 2003 (KR) ..... 10-2003-0046056

(51) Int. Cl.
*G09G 3/36* (2006.01)

(52) U.S. Cl. ..... 345/102

(58) Field of Classification Search ..... 345/102, 345/690

See application file for complete search history.

(56) References Cited

U.S. PATENT DOCUMENTS

| | | | | |
|---|---|---|---|---|
| 6,605,908 | B1 * | 8/2003 | Zhang et al. | 315/307 |
| 6,812,916 | B2 * | 11/2004 | Hwang | 345/102 |
| 2004/0119418 | A1 * | 6/2004 | Moon | 315/169.3 |
| 2006/0120109 | A1 * | 6/2006 | Inoue et al. | 362/614 |

FOREIGN PATENT DOCUMENTS

| | | | |
|---|---|---|---|
| JP | 10-082914 | * | 3/1998 |
| KR | 2002-0061749 A | | 7/2002 |

* cited by examiner

*Primary Examiner*—Amr Awad
*Assistant Examiner*—Randal Willis
(74) *Attorney, Agent, or Firm*—Birch, Stewart, Kolasch & Birch LLP.

(57) ABSTRACT

A backlight driving circuit for an LCD device is disclosed, in which multiple high-voltage parts each having an inverter circuit are provided, and the plurality of high-voltage parts are dispersedly arranged at both rear sides of an LCD panel. The distribution of the high voltage parts obtains a uniform temperature dispersion in the LCD device, and the lifespan of the LCD is therefore enhanced.

5 Claims, 7 Drawing Sheets

BACKLIGHT DRIVING CIRCUIT

This application claims the benefit of Korean Application No. P2003-46056, filed on Jul. 8, 2003, which is hereby incorporated by reference.

BACKGROUND OF THE INVENTION

1. Field of the Invention

The invention relates to a backlight driving circuit for a liquid crystal display (LCD) device, and more particularly, to an arrangement in a backlight driving circuit to improve spatial utilization and temperature stability by arranging inverters for driving fluorescent lamps in a diagonal direction.

2. Description of the Related Art

With rapid development of information communication fields, the importance of displaying desired information has dramatically increased. Cathode ray tubes (CRTs) have recently found common use as display devices in televisions and computer monitors because of their ability to display various colors with high luminance. However, CRTs are relatively large and cannot adequately satisfy present demands for display applications that require reduced weight, portability, low power consumption, increased screen size and high resolution. Flat panel displays have accordingly been developed for use as monitors for computers, spacecraft, and aircraft.

Various flat panel displays that are in use include, for example, a liquid crystal display (LCD) device, an electroluminescent display (ELD), a field emission display (FED), and a plasma display panel (PDP). Currently, practical application of the flat panel displays requires high luminance, great efficiency, high resolution, rapid response time, low driving voltage, low power consumption, low manufacturing cost and natural color display characteristics. Among the flat panel displays, the LCD device has attracted great attention by having portability and endurance as well as the aforementioned characteristics required for the flat panel displays.

The LCD device is a display device exploiting the optical anisotropy of liquid crystals. That is, when light irradiates on the liquid crystal having polarizing characteristics according to an applied voltage state, light transmittance is controlled by the alignment state of the liquid crystal, thereby displaying a picture image. However, the LCD device in and of itself does not emit light, and the LCD device therefore requires an additional light source. One such LCD device is a reflective type LCD device. A reflective type LCD device uses ambient light but has limitations due to the environmental problems such as, e.g., low ambient light levels. As a result, a transmitting type LCD device having an additional light source such as a backlight has been developed. For instance, light sources such as electro-luminescence (EL), a light-emitting diode (LED), a cold cathode fluorescent lamp (CCFL) and a hot cathode fluorescent lamp (HCFL) are used for the backlight of the transmitting type LCD device. Of these, the cold cathode fluorescent lamp (CCFL) is most widely used for the backlight because the CCFL is thin and has low power consumption.

The backlight of the transmitting type LCD device classifies into a direct type and an edge type according to the location of the fluorescent lamp. In the edge type backlight, a cylindrical fluorescent lamp is formed at one side of the LCD panel, and a transparent light-guiding plate is formed to transmit the light emitted from the fluorescent lamp to an entire surface of the LCD panel. The edge type backlight has the problem of low luminance. Also, optical design and processing technology for the light-guiding plate are required to obtain uniform luminance.

Meanwhile, the direct type backlight is suitable for a large sized LCD device of 20 inches or more, in which multiple fluorescent lamps are arranged in one direction below a light-diffusion plate to directly illuminate an entire surface of the LCD panel with light. That is, a direct type backlight unit having great light efficiency finds common use for the large size LCD devices requiring high luminance. However, the direct type is problematic in that a silhouette of the fluorescent lamp may reflect on the LCD panel. Thus, a predetermined interval must be maintained between the fluorescent lamp and the LCD panel, and it is thus hard to obtain a thin profile in an LCD device having a direct type backlight unit. As the panel becomes larger, the size of the light-emitting surface of the backlight increases. With a large-size direct type backlight, an appropriate thickness of a light-scattering means is required. If the thickness of the light-scattering means is not appropriately thin, the light-emitting surface is not flat.

Despite this, the direct type backlight finds use in an LCD device requiring high luminance, and an edge type backlight unit finds general use in relatively small size LCD devices such as monitors of laptop computers and desktop computers. With the trend towards increasingly large sized LCD panels, the direct type backlight is actively developed by forming multiple fluorescent lamps under a screen, or by disposing one bent fluorescent lamp, thereby obtaining a high luminance backlight.

FIG. 1 shows a perspective view illustrating a direct type backlight according to the related art, and FIG. 2 schematically illustrates a fluorescent lamp. As shown in FIG. 1, the direct type backlight according to the related art includes multiple fluorescent lamps 1, an outer case 3, and a light-scattering means 5. The fluorescent lamps 1 are arranged at fixed intervals in one direction, and the outer case 3 fixes the plurality of fluorescent lamps for maintaining the fixed intervals. The light-scattering means 5 is provided above the fluorescent lamps 1. The light-scattering means 5 prevents the silhouette of the fluorescent lamps 1 from being reflected on the display surface of the LCD panel (not shown), and provides a light source with uniform luminance. For improving the light-scattering effect, the light-scattering means 5 is composed of a diffusion plate 5*a* and multiple diffusion sheets 5*b* and 5*c*. Also, a reflecting plate 7 is provided inside the outer case 3 for concentrating the light emitted from the fluorescent lamps 1 to the display part of the LCD panel, thereby improving light efficiency. Also, FIG. 2 shows that the fluorescent lamps 1 are respectively fixed to both sides of the outer case 3. Each fluorescent lamp 1 is a cold cathode fluorescent lamp 1, which is charged with discharge gas. Each fluorescent lamp 1 includes electrodes 2*a* and 2*b* for receiving external power (not shown), and wires 9*a* and 9*b* connected to the electrodes 2*a* and 2*b*. The wires 9*a* and 9*b* are provided A.C. voltage 4 and connect to a driving circuit by an additional inverter (20 in FIG. 3.). Each fluorescent lamp 1 thus requires an additional inverter. Meanwhile, the backlight driving circuit for driving the plurality of fluorescent lamps 1 has the multiple inverter circuits, and is provided at the rear of the backlight.

FIG. 3 shows a circuit diagram illustrating a driving circuit provided at the rear of a related art backlight. FIG. 4 shows a detail view illustrating a low-voltage part of FIG. 3. As shown in FIG. 3, the driving circuit of the related art backlight includes a high-voltage part 21, a low-voltage part 23, and a connection part 25. The high-voltage part 21 is formed at one portion of a rear side of an LCD panel to apply an A.C. high voltage to a first terminal of each fluorescent lamp ('1' of FIG. 1). The low-voltage part 23 is formed at the other portion of the rear side of the LCD panel to apply a lower electric potential (as compared to that of the high-voltage part 21) to a second terminal of each fluorescent lamp ('1' of FIG. 1). The connection part 25 is formed to connect the low-voltage part 23 to a feedback terminal of the high-voltage part 21. The high-voltage part 21 includes multiple inverter circuits 20 for converting a D.C. voltage to an A.C. voltage to drive corresponding fluorescent lamps ('1' of FIG. 1). A group of first connectors 32*a* each connect connecting the first terminal of the fluorescent lamp 1 to the inverter circuit 20. The low-voltage part 23 includes a group of second connectors 32*b*, and each of the second connector 32*b* connect to the second terminal of the fluorescent lamp 1. Also, the connection part 25 includes insulated wires corresponding to the number of fluorescent lamps ('1' of FIG. 2), and first and second feedback connectors 22*a* and 22*b* electrically connect the high-voltage part 21 to the low-voltage part 23. Also, as shown in FIG. 1, the fluorescent lamps are arranged in parallel to the horizontal direction of the LCD panel. Also, the power supplying wires 9*a* and 9*b* are formed at both ends of each fluorescent lamp 1, and are connected by the first connector 32*a* of the high-voltage part 21 and the second connector 32*b* of the low-voltage part 23.

FIG. 3 shows that the connection part 25 may be formed as a single wire, or multiple wires corresponding to the number of fluorescent lamps and according to the control method of the fluorescent lamps 1. The voltage or current of the low-voltage part input by feedback from the inverter circuit 20 controls the current of the fluorescent lamps 1. If a single wire is used, problems may occur due to different characteristics of the respective fluorescent lamps. If a number of wires are used, it is possible to control the fluorescent lamps in due consideration of the impedance of the respective fluorescent lamps 1. As a result, deflection of the current decreases among the multiple fluorescent lamps 1, thereby providing uniform luminance by decreasing the difference in luminance among the fluorescent lamps 1. That is, as shown in FIG. 4, the low-voltage part 23 of the related art backlight includes multiple second connectors 32*b*, each connected to the power supplying wire (9 or 9*a*) of each fluorescent lamp. Multiple power source wires 26 also respectively connect to the second connectors 32*b* and the second feedback connector 22*b* to collect the multiple power source wires 26 on a PCB (printed circuit board). Each of the first and second connectors 32*a* and 32*b* may connect to the power supplying wires of two fluorescent lamps.

FIG. 5 shows a related art circuit diagram schematically illustrating an inverter circuit of a backlight. Each inverter circuit 20 includes first and second switching devices Q1 and Q2, and a high voltage Transformer T1. The first and second switching devices Q1 and Q2 output a driving voltage Vcc1 to a high voltage Transformer T1 by alternately switching the driving voltage Vcc1. The high voltage Transformer T1 includes a primary coil and a secondary coil, in which the primary coil receives the driving voltage Vcc1 from the switching devices Q1 and Q2, and the secondary coil outputs a high voltage according to a winding ratio (n1:n2) of the primary and secondary coils. The first and second switching devices Q1 and Q2 are switched by output of a third coil (n3) for inducing the low voltage from the secondary coil (n2). Herein, L1 is a line filter, R1-R3 are resistors, C1-C3 are condensers (capacitors), and D1 is a diode. As mentioned above, the inverter circuit 20 includes the high voltage Transformer T1. That is, even though the inverter circuit 20 is formed on the PCB, it requires a large space.

The operation of the inverter circuit in the backlight for the related art LCD will be described as follows. First, the inverter driving voltage Vcc1 is input through the line filter L1, and the first and second switching devices Q1 and Q2 alternately switches the inverter driving voltage Vcc1 by push-pull operation, thereby outputting the inverter driving voltage Vcc1 applied to a collector to the primary side of the Transformer T1. Then, the Transformer T1 outputs the voltage induced to the primary side n1 to the secondary side n2 according to the winding ratio of n1 to n2, and outputs the A.C. high voltage to the fluorescent lamp 1 through the first connector 32*a*. By the A.C. high voltage output from the high voltage Transformer T1, the current flows in the fluorescent lamps 1 through the first and second connectors 32*a* and 32*b*. At this time, the voltage corresponding to resistor capacity R3 and the current flowing in the fluorescent lamp 1 generates in the second connector 32*b*. That is, the voltage corresponding to current×resistance R3 of the fluorescent lamp 1 is caught by the second connector 32*b*.

However, the backlight driving circuit according to the related art has many disadvantages, including those discussed below.

As LCD devices become larger, it becomes necessary to increase the length of the fluorescent lamp. Thus, one needs to increase the capacity and size of the components of the inverter circuit. In the related art backlight driving circuit shown in FIG. 3, the high-voltage part having the inverter circuit is formed at one portion of the rear side of the LCD module, and the low-voltage part is formed at the other portion of the LCD module. Accordingly, the size of the PCB forming the high-voltage part becomes greater than that of the vertical size of the LCD module due to the size of the high voltage transformer of the inverter circuit, thereby increasing the outer size of the LCD device.

Also, since the high-voltage part having the inverter circuit is formed at one portion of the rear side of the LCD module, and the low-voltage part is formed at the other portion thereof, it becomes difficult to obtain a uniform temperature distribution in the portions forming the high-voltage part and the low-voltage part, thereby shortening the lifespan of the fluorescent lamp due to deflection of the gas therein.

FIG. 6 shows a temperature distribution graph of an LCD device having a related art arrangement of a backlight driving circuit. The high-voltage part includes an inverter circuit containing a high voltage transformer, whereby the high-voltage part emits relatively greater heat than that of the low-voltage part. Also, the high-voltage part absorbs heat generated from the fluorescent lamp. Accordingly, the temperature difference between the high-voltage part and the low-voltage part becomes large. FIG. 6 illustrates the result of a temperature gradient at a rear side of a bottom cover in the LCD device when the environmental atmosphere is at a temperature of 28° C. Accordingly, if the fluorescent lamp is driven for a long time, gas such as mercury is deflected, thereby shortening the lifespan of the fluorescent lamp.

SUMMARY OF THE INVENTION

Accordingly, the invention is directed to a backlight driving circuit of an LCD device that substantially obviates one or more problems due to limitations and disadvantages of the related art.

An object of the invention is to provide a backlight driving circuit of an LCD device to improve spatial utilization and temperature stability by arranging inverters for driving fluorescent lamps in a diagonal direction.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

The invention, in part, pertains to a direct-type backlight driving circuit that includes multiple high-voltage parts each having an inverter circuit, and the multiple high-voltage parts are dispersedly arranged at both rear sides of an LCD panel. In the invention, the inverter circuit contains a line filter, first and second switching devices to alternately switch an inverter driving voltage by push-pull operation, thereby outputting the inverter driving voltage to a collector at a primary side of a transformer, and the transformer outputs the voltage induced at the primary side to a secondary side of the transformer. Each high-voltage part can be connected to a corresponding low voltage part through a connection part. A protection circuit can be formed in each low voltage part. The high-voltage parts are arranged in a zigzag configuration alternating with the low voltage parts so as to prevent concentration of the high-voltage parts to one side of the LCD panel. Also, a uniform temperature dispersion is obtained.

The invention, in part, pertains to a backlight driving circuit that includes multiple fluorescent lamps divided into two, first and second blocks; a first high-voltage part at a first portion of a rear side of an LCD panel to apply an A.C. high voltage to the fluorescent lamps arranged in the first block; a first low-voltage part at a second portion of the rear side of the LCD panel to apply a lower electric potential than that of the first high-voltage part to the plurality of fluorescent lamps arranged in the first block; a first connection part connecting the first low-voltage part to a feedback terminal of the first high-voltage part; a second high-voltage part at the second portion of the rear side of the LCD panel to apply an A.C. high voltage to the plurality of fluorescent lamps arranged in the second block; a second low-voltage part at the first portion of the rear side of the LCD panel to apply a lower electric potential than that of the second high-voltage part to the plurality of fluorescent lamps arranged in the second block; and a second connection part connecting the second low-voltage part to a feedback terminal of the second high-voltage part.

In the invention, a protection circuit can be provided between the first or second low-voltage part and the first or second connection part. The protection circuit can include multiple zener diodes and a resistor. The zener diodes can be respectively connected to a power source and a grounding terminal in different directions, and the resistor is connected to the zener diodes. The zener diodes and the resistor can be formed on a PCB (Printed Circuit Board) of the low-voltage part. Also, the first and second feedback connectors can be respectively formed to connect the first and second high-voltage parts to the first and second low-voltage parts. The first and second high-voltage parts can include multiple first connectors each connected to a first terminal of the corresponding fluorescent lamp, and the first and second low-voltage parts can include multiple second connectors each connected to a second terminal of the corresponding fluorescent lamp. Each of the first and second connectors can be connected to two or more fluorescent lamps.

It is to be understood that both the foregoing general description and the following detailed description of the invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Reference will now be made in detail to the preferred embodiments of the invention, examples of which are illustrated in the accompanying drawings. Wherever possible, the same reference numbers will be used throughout the drawings to refer to the same or like parts.

Hereinafter, a backlight driving circuit according to the invention will be described with reference to the accompanying drawings.

Figure 1:
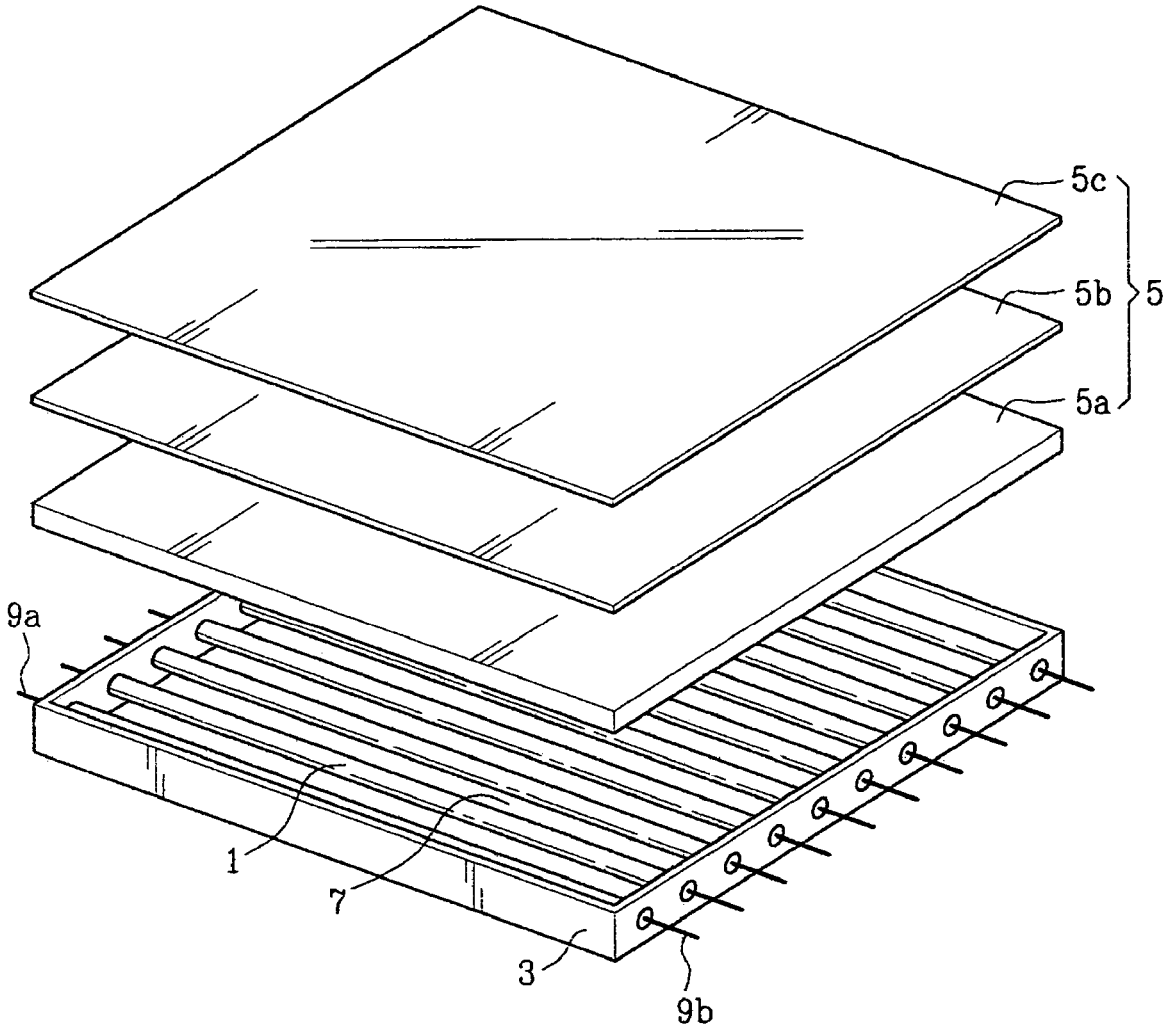
FIG. 1 Related Art
FIG. 1 shows a perspective view illustrating a related art direct-type backlight.
Figure 2:
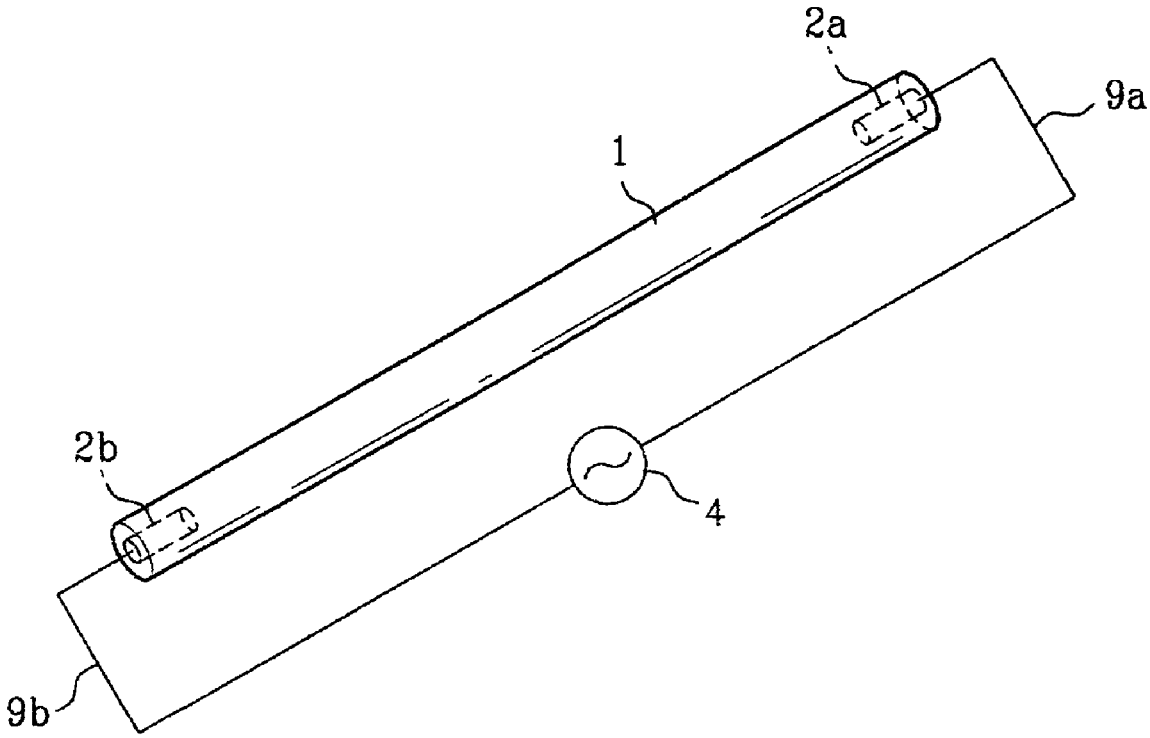
FIG. 2 Related Art
FIG. 2 shows an explanatory diagram schematically illustrating a related art fluorescent lamp.
Figure 3:
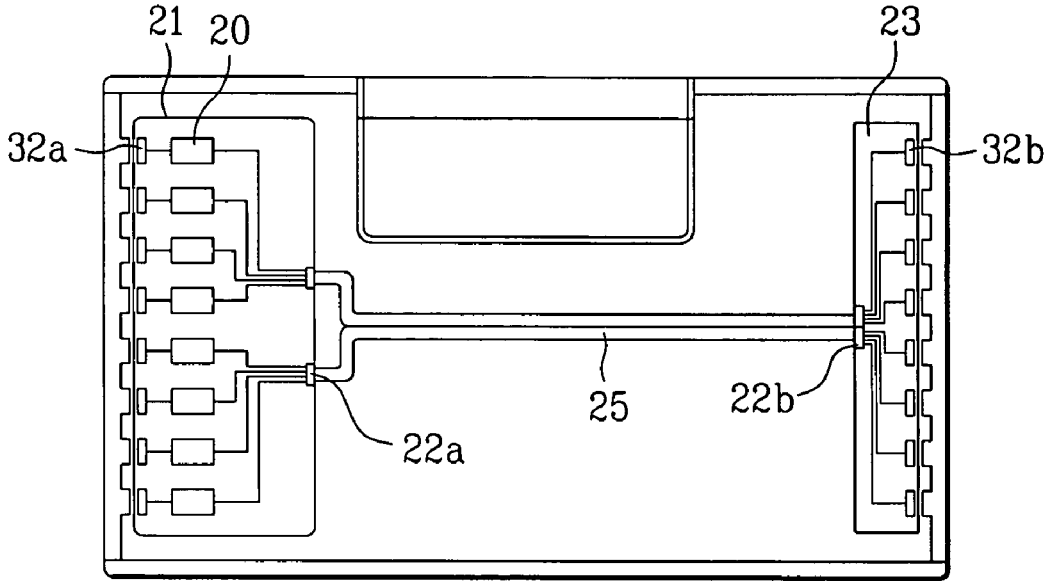
FIG. 3 Related Art
FIG. 3 shows a circuit diagram illustrating a related art driving circuit provided at the rear of a backlight.
Figure 4:
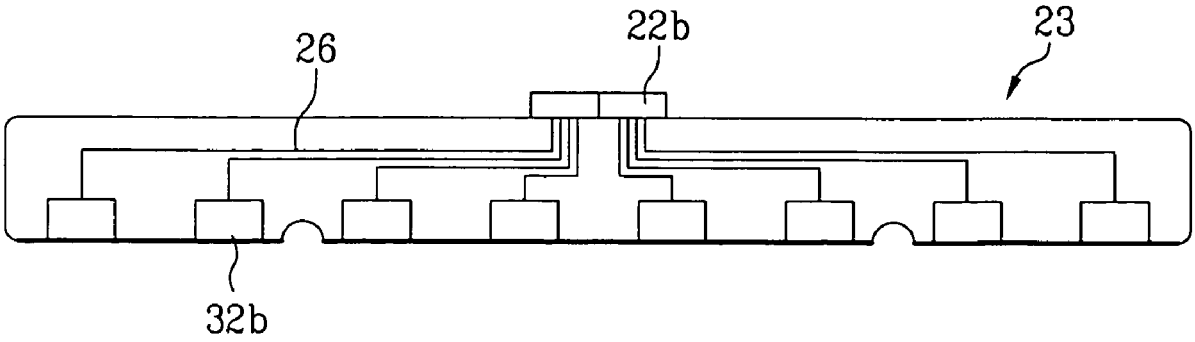
FIG. 4 Related Art
FIG. 4 shows a plane view partially illustrating a low-voltage part of FIG. 3.
Figure 7:
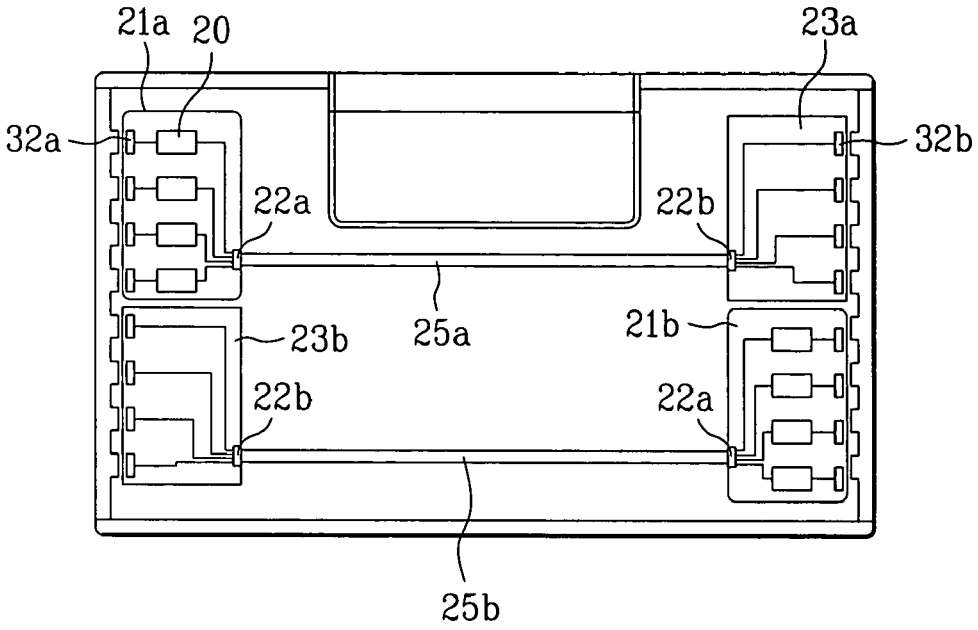
FIG. 7 shows a circuit diagram illustrating a backlight driving circuit according to a first embodiment of the invention.

FIG. 7 shows a circuit diagram illustrating a backlight driving circuit according to a first embodiment of the invention. In the invention, as shown in FIG. 1 (which shows the inventor's own work), multiple fluorescent lamps 1 are arranged and fixed to an outer case 3 at fixed intervals in parallel to a longitudinal direction of an LCD module. Then, a light-scattering means 5 is provided above the fluorescent lamps 1. The light-scattering means 5 prevents the silhouette of the fluorescent lamps 1 from being reflected on a display surface of an LCD panel, and provides a light source with uniform luminance. For improving the light-scattering effect, the light-scattering means 5 is composed of a diffusion plate 5*a* and multiple diffusion sheets 5*b* and 5*c*. There is no restriction to the amount of diffusion elements that can be used, but a minimum number, i.e., one, would be the most preferred configuration. A reflecting plate 7 provided inside the outer case 3 concentrates the light emitted from the fluorescent lamps 1 to a display part of the LCD panel, thereby improving light efficiency. The fluorescent lamps 1 are respectively fixed to both sides of the outer case 3. Each fluorescent lamp 1 includes electrodes 2*a* and 2*b*, and wires 9*a* and 9*b* connected to the electrodes 2*a* and 2*b*. In this state, the plurality of fluorescent lamps 1 are divided into two blocks (first and second blocks).

FIG. 7 shows the inventive backlight driving circuit that includes a first high-voltage part 21*a*, a first low-voltage part 23*a*, a first connection part 25*a*, a second high-voltage part 21*b*, a second low-voltage part 23*b*, and a second connection part 25*b*. The first high-voltage part 21 a is formed at a first portion of a rear side of the LCD panel to apply an A.C. high voltage to each first terminal of multiple fluorescent lamps arranged to be parallel to one another at fixed intervals in the first block. The first low-voltage part 23*a* is formed at a second portion of the rear side of the LCD panel to apply a lower electric potential than that of the first high-voltage part 21*a* to each second terminal of the multiple fluorescent lamps arranged in the first block. The first connection part 25*a* connects the first low-voltage part 23*a* to a feedback terminal of the first high-voltage part 21*a*. Also, the second high-voltage part 21*b* is formed at the second portion of the rear side of the LCD panel to apply an A.C. high voltage to each second terminal of multiple fluorescent lamps arranged in the second block. The second low-voltage part 23*b* is formed at the first portion of the rear side of the LCD panel to apply a lower electric potential than that of the second high-voltage part 21*b* to each first terminal of the multiple fluorescent lamps arranged in the second block. The second connection part 25*b* connects the second low-voltage part 23*b* to a feedback terminal of the second high-voltage part 21*b*.

Figure 5:
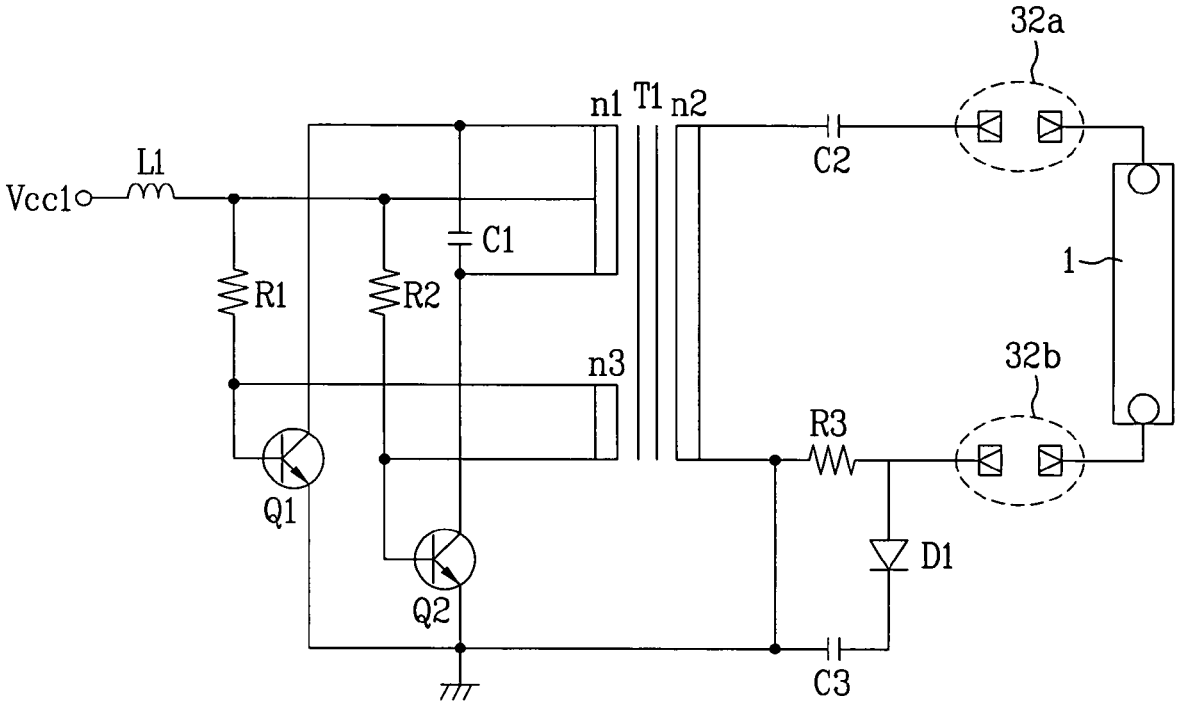
FIG. 5 Related Art
FIG. 5 shows a circuit diagram schematically illustrating an inverter circuit of a related art backlight.
Figure 6:
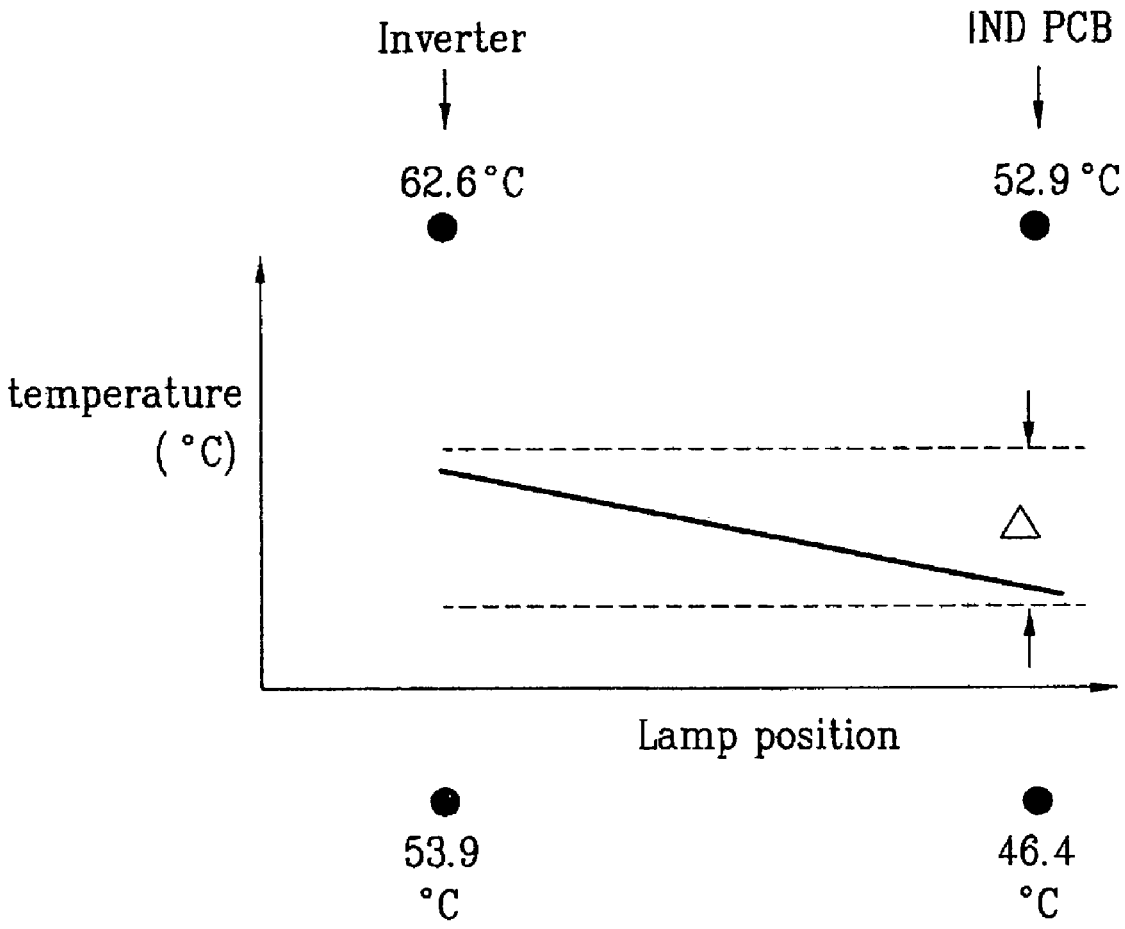
FIG. 6 Related Art
FIG. 6 shows a temperature distribution graph of a related art LCD device having a backlight driving circuit.

Each of the first and second high-voltage parts 21*a* and 21*b* includes multiple inverter circuits 20, and multiple first connectors 32*a*. The inverter circuit 20 is connected to the fluorescent lamp 1 and inverts a D.C. voltage to an A.C. voltage, thereby driving the corresponding fluorescent lamp. Also, the first connector 32*a* connects the terminal of the corresponding fluorescent lamp 1 to the inverter circuit 20. The inverter circuit 20 is similar to the one shown in FIG. 5. Each of the first and second low-voltage parts 23*a* and 23*b* has multiple second connectors 32*b*, each connected to the terminal of the corresponding fluorescent lamp 1. Each of the first and second connection parts 25*a* and 25*b* has insulating wires corresponding to the number of the corresponding fluorescent lamps. Furthermore, first and second feedback connectors 22*a* and 22*b* respectively connect the first and second high-voltage parts 21*a* and 21*b* to the first and second low-voltage parts 23*a* and 23*b*.

Each of the first and second connection parts 25*a* and 25*b* may be formed of a single wire, or multiple wires according to a method of controlling the fluorescent lamp 1. Also, each of the first and second connectors 32*a* and 32*b* may be connected to two or more fluorescent lamps 1, but they can also be connected to one fluorescent lamp. Furthermore, in the backlight driving circuit of FIG. 7, the fluorescent lamps are divided into the two blocks. However, it is possible to divide the multiple fluorescent lamps to three or more blocks, each block having the high-voltage part, the low-voltage part, and the connection part. In this state, the respective high-voltage parts may be arranged in a zigzag type configuration so as to prevent concentration of the high-voltage parts to one side of the LCD panel. Also, when a high voltage generates by insertion failures (not shown) of the first and second feedback connectors 22*a* and 22*b* (or other failures caused by damage), a protection circuit 30 may be formed inside the first and second low-voltage parts 23*a* and 23*b* for grounding the high voltage.

Figure 8:
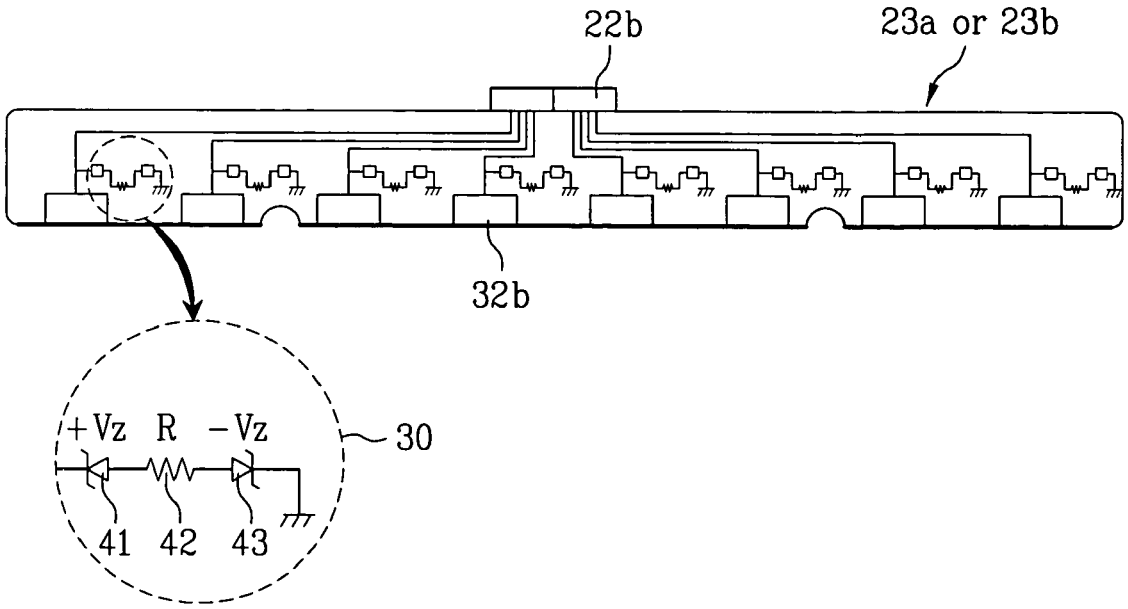
FIG. 8 shows a detailed view illustrating a low-voltage part according to a second embodiment of the invention.

FIG. 8 shows an expanded view illustrating first or second low-voltage part (23*a* or 23*b*) according to a second embodiment of the invention. Here, the high voltage generates between the respective inverter circuits 20 of the first and second high-voltage parts 21*a* and 21*b* and the first and second low-voltage parts 23*a* and 23*b*. In this case, if insertion failures of the first and second feedback connectors 22*a* and 22*b* to the first or second high-voltage part 21*a* or 21*b* (or the first or second low-voltage part 23*a* or 23*b*) exist, then sparks (electric discharge) generate by a voltage difference between pins, whereby it may damage the driving circuit. Accordingly, the protection circuits 30 are respectively formed inside the first and second low-voltage parts 23*a* and 23*b* for grounding the high voltage generated between the first/second high-voltage parts 21*a* and 21*b* and the first/second low-voltage parts 23*a* and 23*b*, thereby protecting the backlight driving circuit. The protection circuit 30 contains first and second zener diodes 41 and 43 connected in series between the ground terminal and the connector 32*b*, and a resistor 42. Also, the first and second zener diodes 41 and 43 are connected in different directions. The breakdown voltage is the zener voltage for zener diodes. While for a conventional rectifier or diode it is imperative to operate below this voltage; the zener diode is intended to operate at that voltage, and so finds its greatest application as a voltage regulator.

Figure 9:
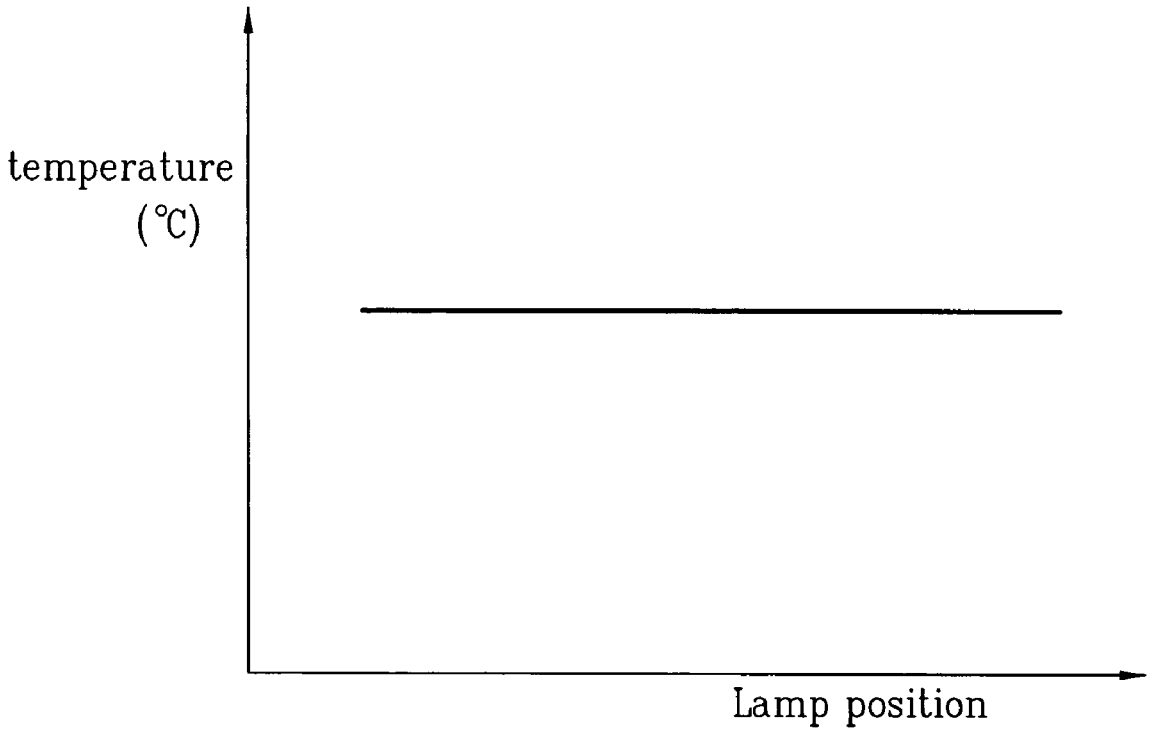
FIG. 9 shows a temperature distribution graph of an LCD device having an arrangement of a backlight driving circuit according to the invention.

FIG. 9 shows a temperature distribution graph of an LCD device using an arrangement and a backlight driving circuit according to the invention. As shown in FIG. 9, the high-voltage parts emitting relatively great amount of heat are dispersedly arranged at both sides of the LCD panel, thereby obtaining a uniform temperature distribution. Accordingly, even when the fluorescent lamp and the inverter circuit of the high-voltage part emit heat, there is no temperature difference, thereby obtaining excellent optical characteristics and reliability.

As discussed above, the backlight driving circuit according to the invention has many advantages, including the following.

First, the high-voltage parts having a relatively large size are dispersedly arranged at both sides of the LCD panel, whereby it is possible to provide a PCB of the backlight driving circuit that is within the size of the LCD module. Thus, it is possible to prevent the outer size of the LCD module from being increased.

Also, since the relatively large sized high-voltage parts are dispersedly arranged at both sides of the LCD panel, it becomes possible to obtain a uniform temperature dispersion in the LCD device. Thus, one can prevent the lifespan of the fluorescent lamp from being shortened due to the temperature deflection and temperature gradient.

Even though it is required to increase the length of the fluorescent lamp according to the large sized LCD device, and to increase the size in the high voltage transformer of the inverter circuit, it becomes possible to prevent the PCB size from being increased. Accordingly, providing a backlight for a large sized LCD device becomes possible.

It will be apparent to those skilled in the art that various modifications and variations can be made in the invention. Thus, it is intended that the invention covers the modifications and variations of this invention provided they come within the scope of the appended claims and their equivalents.

What is claimed is:

1. A backlight driving circuit comprising:

a plurality of fluorescent lamps divided into first and second blocks, wherein each fluorescent lamp has first and second terminals;

a first high-voltage part at a first portion of a rear side of an LCD panel to apply an A.C. high voltage to the first terminal of each fluorescent lamp arranged in the first block, wherein the first high-voltage part includes a plurality of first inverter circuits and a plurality of first connectors, wherein each first inverter circuit converts a D.C. voltage to the A.C. voltage, wherein each first connector connects the first terminal of the fluorescent lamp arranged in the first block to one terminal of the first inverter circuit;

a first low-voltage part at a second portion of the rear side of the LCD panel to apply a lower electric potential than that of the first high-voltage part to the second terminal of each fluorescent lamp arranged in the first block, wherein the first low-voltage part includes a plurality of second connectors each connecting to the second terminal of the fluorescent lamp arranged in the first block;

a first connection part connecting the first low-voltage part to a feedback terminal of the first high-voltage part, wherein the first connection part includes insulated wires corresponding to a number of fluorescent lamps arranged in the first block, and first and second feedback connectors electrically connecting the first high-voltage part to the first low-voltage part, wherein other terminals of the first inverter circuits are connected to the first feedback connector, wherein the second connectors are connected to the second feedback connector;

a second high-voltage part at the second portion of the rear side of the LCD panel to apply an A.C. high voltage to the second terminal of each fluorescent lamp arranged in the second block, wherein the second high-voltage part includes a plurality of second inverter circuits and a plurality of third connectors, wherein each second inverter circuit converts a D.C. voltage to the A.C. voltage, wherein each third connector connects the second terminal of the fluorescent lamp arranged in the second block to one terminal of the second inverter circuit;

a second low-voltage part at the first portion of the rear side of the LCD panel to apply a lower electric potential than that of the second high-voltage part to the first terminal of each fluorescent lamp arranged in the second block, wherein the second low-voltage part includes a plurality of fourth connectors each connecting to the first terminal of the fluorescent lamp arranged in the second block;

a second connection part connecting the second low-voltage part to a feedback terminal of the second high-voltage part, wherein the second connection part includes insulated wires corresponding to a number of fluorescent lamps arranged in the second block, and third and fourth feedback connectors electrically connecting the second high-voltage part to the second low-voltage part, wherein other terminals of the second inverter circuits are connected to the third feedback connector, wherein the fourth connectors are connected to the fourth feedback connector, wherein the first and second high-voltage parts are arranged in a zigzag configuration alternating with the first and second low-voltage parts so as to prevent concentration of the high-voltage parts to one side of the LCD panel; and a protection circuit formed in the first and second low-voltage parts, wherein the protection circuit grounds a high voltage when the high voltage generates by connection failures between the first and second feedback connectors of the first connection part and the first high-voltage parts, when the high voltage generates by connection failures between the third and fourth feedback connectors of the second connection part and the second high-voltage part, when the high voltage generates by connection failures between the first and second feedback connectors of the first connection part and the first low-voltage part, or when the high voltage generates by connection failures between the third and fourth feedback connectors of the second connection part and the second low-voltage part.

2. The backlight driving circuit of claim 1, wherein the protection circuit includes a plurality of zener diodes and a resistor.

3. The backlight driving circuit of claim 2, wherein the plurality of zener diodes are respectively connected to a power source and a grounding terminal in different directions, and the resistor is connected to the plurality of zener diodes.

4. The backlight driving circuit of claim 2, wherein the plurality of zener diodes and the resistor are formed on a PCB (Printed Circuit Board) of the first and second low-voltage parts.

5. The backlight driving circuit of claim 1, wherein a uniform temperature dispersion is obtained.

* * * * *